US005518479A

United States Patent [19]

Young et al.

[11] Patent Number: 5,518,479

[45] Date of Patent: May 21, 1996

[54] VARIABLE RESISTANCE LEG EXERCISING DEVICE

[76] Inventors: Darel Young; Patricia A. Young, both of 11980 Valencia Ct., Seminole, Fla. 34642

[21] Appl. No.: 404,792

[22] Filed: Mar. 15, 1995

[51] Int. Cl.[6] ..... A63B 21/04

[52] U.S. Cl. ..... 482/121; 482/127; 482/908

[58] Field of Search ..... 482/114, 115, 482/121, 122, 123, 126, 127, 128, 129, 130, 131, 133, 908, 905

[56] References Cited

U.S. PATENT DOCUMENTS

| | | | |
|---|---|---|---|
| 4,226,415 | 10/1980 | Wright | 482/123 |
| 5,072,932 | 12/1991 | Johnson | 482/121 |
| 5,184,994 | 2/1993 | Morris et al. | 482/905 |
| 5,320,591 | 6/1994 | Harmon et al. | 482/121 |
| 5,454,769 | 10/1995 | Chen | 482/908 |

*Primary Examiner*—Stephen R. Crow

*Attorney, Agent, or Firm*—Joseph C. Mason, Jr.; Ronald E. Smith; Louise A. Foutch

[57] ABSTRACT

An exercise device includes an elongate padded base upon which an exerciser reclines on his or her side to perform leg lifts. An "L"-shaped resistance bar is pivotally mounted to a side edge of the base, and includes a cross bar part that extends transversely with respect to the longitudinal axis of the base. The cross bar is positioned in longitudinally spaced apart relation to a foot end of the base so that the exerciser performs leg lifts by placing an ankle beneath the cross bar and alternately raising and lowering the cross bar against a resistance. The resistance may be set at differing levels by setting a pair of handles in a number of differing combinations of settings. Each handle is independently connected to a coiled spring and each handle has a plurality of resistance settings. The exerciser can therefore set the resistance at different levels by selecting unique handle positions.

7 Claims, 4 Drawing Sheets

VARIABLE RESISTANCE LEG EXERCISING DEVICE

BACKGROUND OF THE INVENTION

1. Field of the Invention

This invention relates, generally, to exercise devices. More particularly, it relates to a leg exerciser.

2. Description of the Prior Art

The art includes numerous leg exercising devices. U.S. Pat. No. 4,226,415 to Wright discloses a longitudinally extending table having a transversely disposed, movable cross bar mounted thereabove so that an exerciser may displace the cross bar by employing leg muscles, thereby strengthening said muscles. Resistance to movement of the cross bar is adjustable by means of valves connected to a hydraulic actuator. Such actuators are relatively expensive, however, and difficult to maintain in good operating condition.

Other exercise devices enable the exerciser to adjust the amount of resistance to muscle power through the use of weights; such devices are disclosed in U.S. Pat. Nos. 4,405,128 to Mclaughlin et. al. and 4,634,127 to Rockwell. In devices of this type, variable resistance is obtained by changing the amount of weights to which the movable parts of the machine are connected. Weights, of course, are heavy. They make devices that rely on them expensive to ship.

Still other devices employ springs; examples of such devices are found in U.S. Pat. Nos. 5,002,271 to Gonzales, 5,072,932 to Johnson, and German patent No. 23 35 022. None of these device include any means for adjusting the bias of the springs. Springs are inexpensive, light-in-weight, and easy to maintain.

What is needed, then, is an exercising device having a resistance supplied by springs or equivalents thereof which can be easily adjusted by the exerciser. In view of the prior art at the time the present invention was made, however, it was not obvious to those of ordinary skill in the art of machine design how the needed device could be supplied.

SUMMARY OF THE INVENTION

The present invention includes an elongate base upon which as exerciser reclines. The base is light in weight and may be supported by a floor or a table as desired by the exerciser. Moreover, the base is padded for the exerciser's comfort.

The base has two parts that are hingedly connected to one another along a transversely disposed folding line; this enables folding of the base to decrease its length when it is to be stored.

When the device is in its fully deployed configuration, it occupies a horizontal plane. The head of an exerciser is positioned at a first end of the base and the exerciser's feet overhang the second end of the base.

A transversely disposed, padded cross bar is positioned in longitudinally spaced apart relation from said second end of the base, in substantially the same horizontal plane within which the base is positioned, so that an exerciser lying on his or her side may place one ankle below said cross bar. Exercise is then undertaken by alternately lifting and lowering the leg against a resistance supplied to the cross bar. The exerciser may also lay in a supine or other position and lift the bar repetitively.

The cross bar is the transversely extending part of an elongate, "L"-shaped resistance bar that includes a longitudinally extending part in addition to said cross bar part. The longitudinally extending part is spaced apart from the base and is parallel to a side thereof. The resistance bar has a telescopic construction so that its length is adjustable to fit exercisers of differing heights, and the construction locks the cross bar against rotation at each telescopic setting.

The resistance bar is pivotally mounted to the housing of a variable resistance means that is fixedly secured to a preselected edge of the base.

The variable resistance means includes a pair of coiled springs disposed in closely spaced lateral relation to one another within said housing. A handle that extends out of the housing so that it can be selectively manipulated by an exerciser is affixed to each coiled spring. A number of settings are provided for each handle, each of which is independent of the settings for the handle associated with the other coiled spring. Movement of a handle from one setting to another changes the amount of resistance offered by the spring associated with that handle. Since there are two independent springs and two independent handles, the exerciser can manipulate the handles independently and thereby generate a large number of combinations that provide differing amounts of resistance to movement of the cross bar.

For example, suppose a first handle has "low," "medium," and "high" positions, where the magnitude of the resistance supplied by a first coiled spring is indicated by the name of the setting. Suppose further that a second handle has the same settings and is connected to a second coiled spring. Both handles may be placed on the "low" setting, the first may be placed on "low" while the second is placed on "medium" or "high," both may be placed on the "medium setting," or the first may be placed on "medium" while the second is placed on "high," or both may be placed on "high." Thus, although there are only three settings, in this example, for each coiled spring, there are a total of six combinations of settings: a low-low setting, a low-medium setting, a low-high setting, a medium-medium setting, a medium-high setting, and a high-high setting.

Thus it is clear that the primary object of this invention is to advance the art of exercising devices by providing a spring-based device having multiple combinations of settings to increase the exerciser's range of choices when selecting a resistance setting prior to commencement of an exercise routine.

Another important object is to accomplish the foregoing object with an elegant mechanism so that the exercise device is rugged yet inexpensive.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
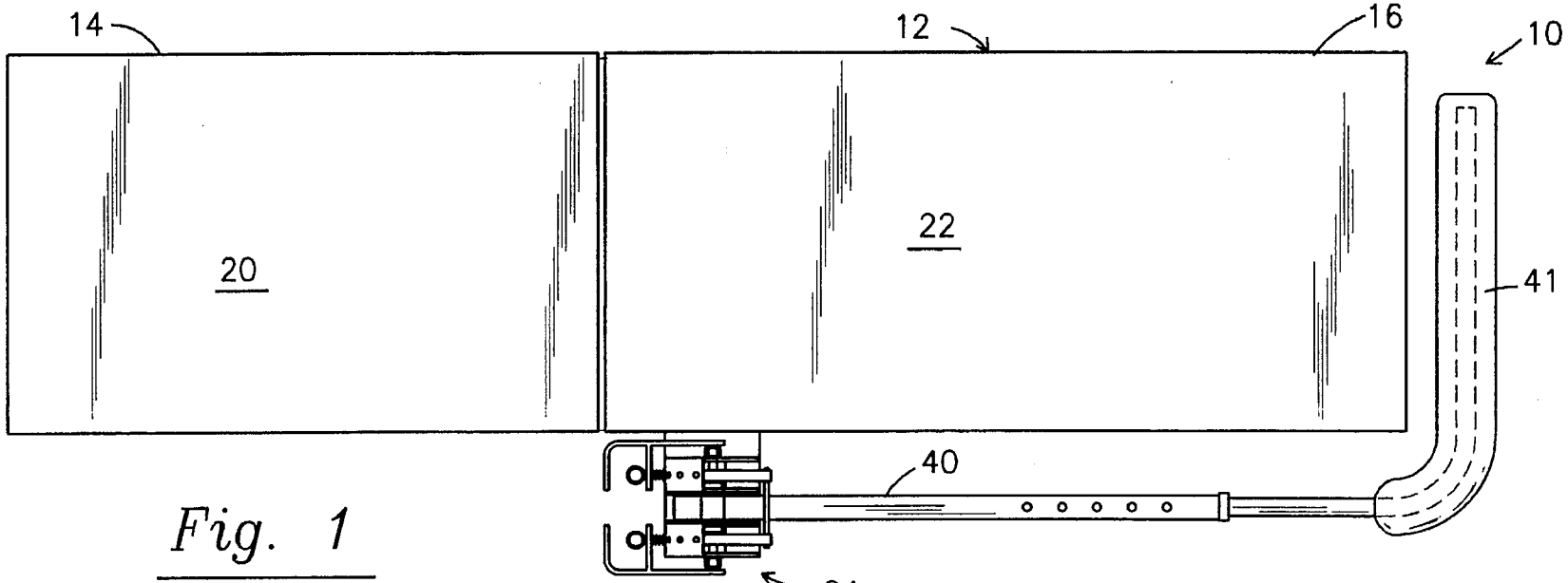
FIG. 1 is a top plan view of an illustrative embodiment of the invention when in repose.

Referring now to FIG. 1, it will there be seen that an illustrative embodiment of the invention is denoted as a whole by the reference numeral 10.

Figure 2:
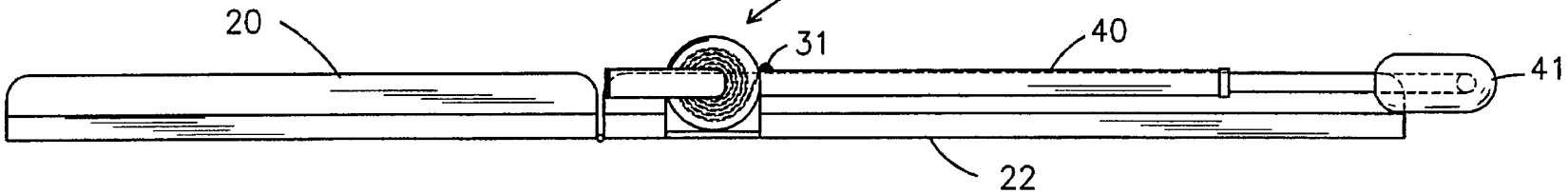
FIG. 2 is a side elevational view thereof.
Figure 4:
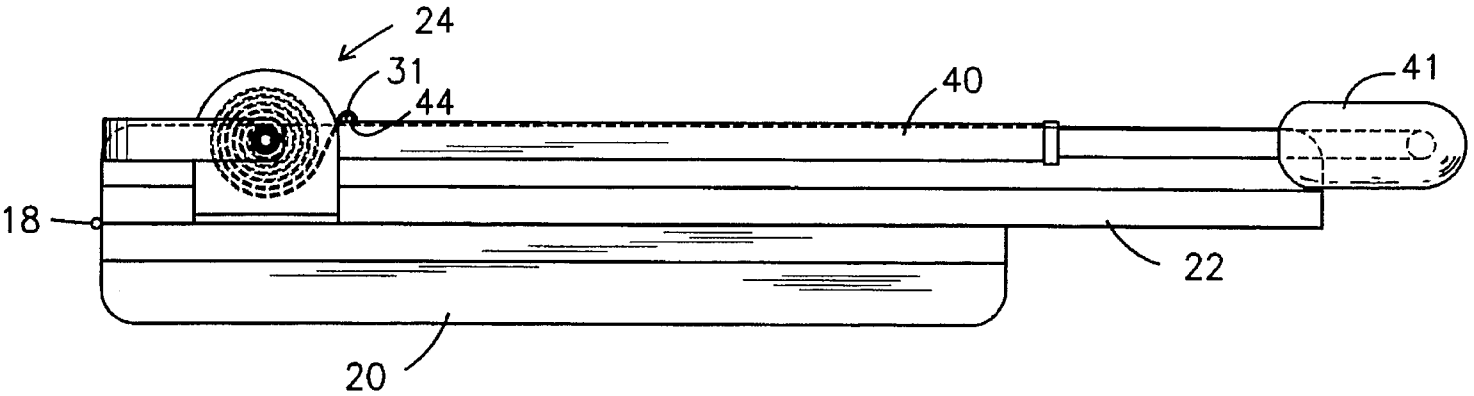
FIG. 4 is a side elevational view thereof when said embodiment is in its folded, storage configuration.

Exercise device 10 includes elongate padded base 12 having a head end 14 and a foot end 16. Transversely disposed hinge 18 (FIG. 2) enables folding of head part 20 into underlying relation to foot part 22 for storage purposes; FIG. 4 depicts the device when so folded.

Housing 24 is nonrotatably mounted to a preselected side edge of foot part 22 of base 12. As best understood in connection with FIGS. 5 and 9–11, it houses first coiled spring 26 in a nonrotatably mounted subhousing 28 and second coiled spring 30 in a nonrotatably mounted subhousing 32. Spring 26 is coiled about and has a trailing end secured to rotatable axle or pin 34. Spring 30 is coiled about and has a trailing end secured to rotatable axle or pin 36; axles or pins 34 and 36 are unconnected to one another so that the bias associated with each spring 26, 30 may be adjusted independently of the other spring.

Figure 5:
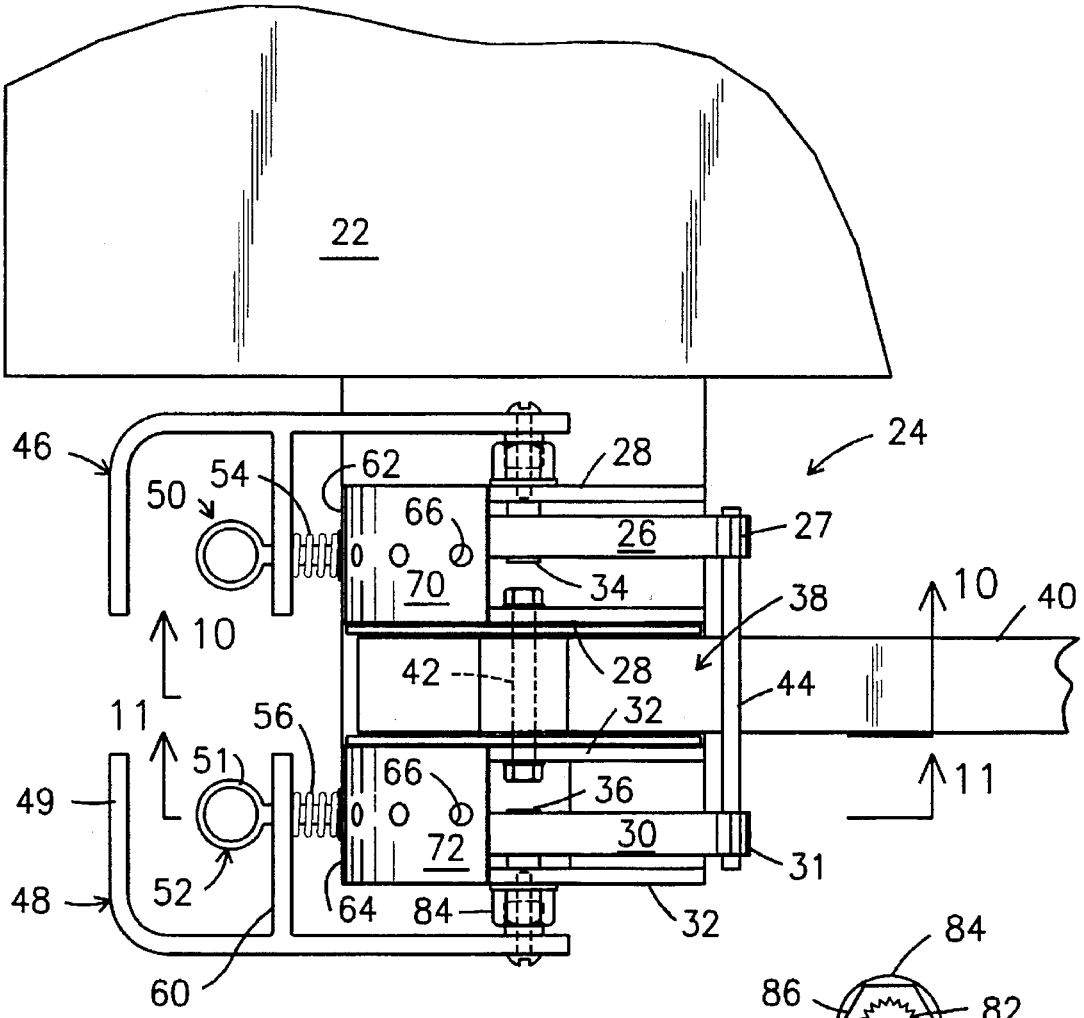
FIG. 5 is a top plan view of the novel adjustment mechanism.

The proximal end 38 of telescoping resistance bar 40 (having padded cross bar 41) is positioned in sandwiched relation between nonrotatable housings 28 and 32, and is rotatable about axle 42 which extends therethrough as perhaps best depicted in FIG. 5. A plurality of openings, collectively denoted 39 in FIG. 1, selectively receive an outwardly biased pin to lock the telescoping arm in any position of telescopic adjustment. Importantly, the pin also serves to prevent rotation of cross bar 41.

Figure 3:
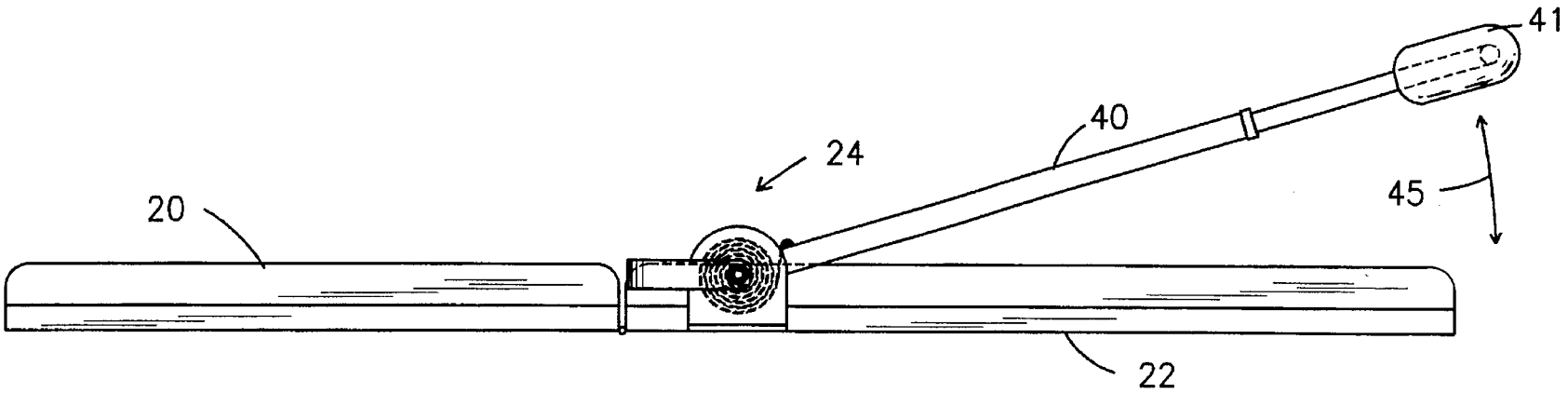
FIG. 3 is a side elevational view thereof when the resistance arm has been displaced away from its in repose position.
Figure 9:
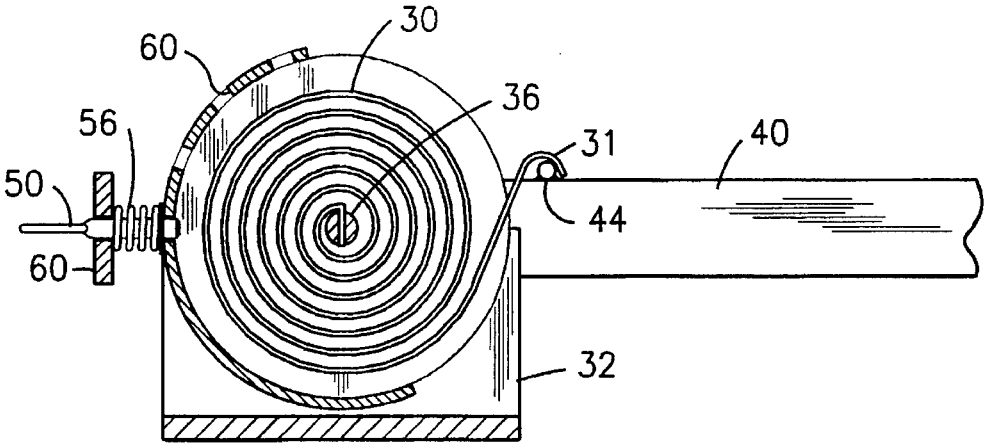
FIG. 9 is a sectional view of the spring housing and related parts.
Figure 10:
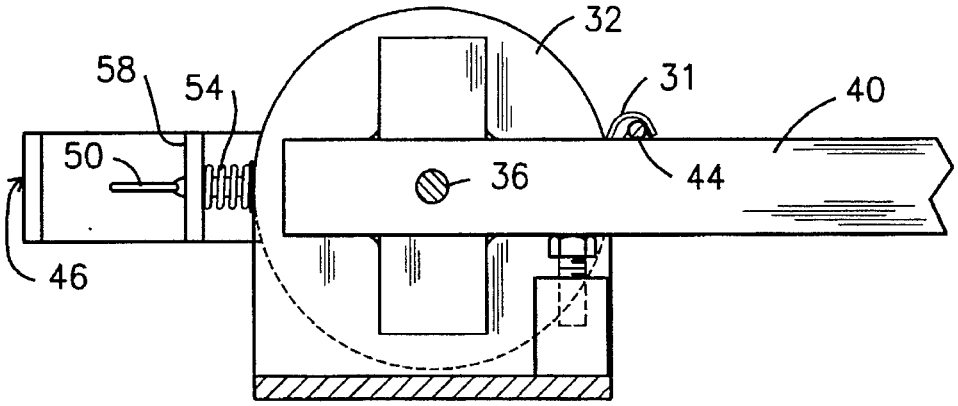
FIG. 10 is a sectional view taken along line 10—10 in FIG. 5.
Figure 11:
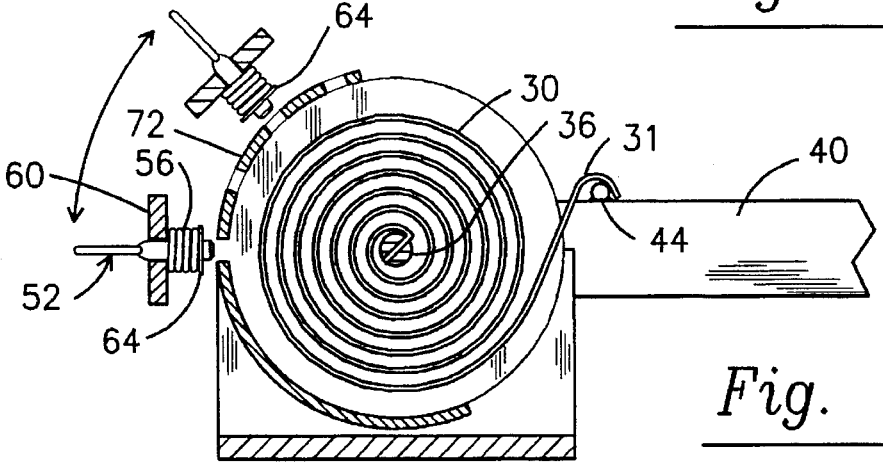
FIG. 11 is a sectional view taken along line 11—11 in FIG. 5.

The respective leading ends 27 and 31 of springs 26 and 30, respectively, are secured to transverse rod 44 by any suitable means. Note from FIG. 2 how transverse rod 44 overlies resistance bar 40 and maintains it in coplanar relation to base 12 when springs 26 and 30 are in repose. In this embodiment, said spring leading ends are bent as depicted in FIGS. 9–11 and overlie rod 44; this enables facile disassembly of the device if a spring were to require replacement or if other maintenance or repair work is needed. Pivotal movement of the resistance bar in the direction indicated by directional arrow 45 in FIG. 3 is thus resisted by the bias supplied by each coiled spring.

In the preferred embodiment, the outer end of axle or pin 34 is engaged by a handle 46 and the outer end of axle or pin 36 is engaged by handle 48. Accordingly, rotation of handles 46 and 48 effects simultaneous and corresponding rotation of said pins and rotation of said pins serves to change the amount of resistance offered by said springs because the respective trailing ends of said springs are secured to their respective pins as aforesaid.

Each handle 46, 48 is independently positionable in four positions of adjustment in this embodiment, although differing numbers of positions are well within the scope of this invention. Therefore, there are ten combinations of settings for the handles so that the exerciser may perform exercises with ten different degrees of resistance.

Each handle is selectively lockable into each position of adjustment. The locking means includes a detent 50 (handle 46) and 52 (handle 50) that is biased radially inwardly by bias means 54, 56, respectively, to engage a preselected aperture formed in a curved plate 70, 72 that forms a part of each subhousing 28, 32, respectively, said apertures being collectively denoted 66.

More particularly, the radially outermost end of each bias means 54, 56 abuts a shelf 58, 60 formed integrally with handle 46, 48, respectively, and the radially innermost end of each spring abuts a stop plate 62, 64 that is secured to its associated detent a short distance from the distal free end thereof as perhaps best understood in connection with FIG. 11. Thus, when the bias means is in repose, it bears against its associated stop plate and drives the distal free end of its associated detent into a preselected aperture 66.

In FIGS. 5 and 9, springs 54 and 56 are in repose so detents 50 and 52 are in engagement with a preselected aperture 66 and handles 46, 48 are thus locked into their respective positions. When both handles are locked in the position of FIG. 5, both coiled springs 26 and 30 are in their lowest bias configuration and thus the resistance supplied to movement of resistance bar 40 is at a minimum.

To move handle 48, a user rests his or her palm against handle part 49 (see FIG. 5), grasps detent 52 by inserting a finger in loop 51 formed in the radially outermost end thereof, and pulls detent 52 radially outwardly, compressing bias means 56. This withdraws detent 52 from aperture 66, and the handle is then moved to the desired setting as suggested in FIG. 11. Detent 52 is then released so that bias means 56 drives it into the selected aperture 66.

Since handle 48 is secured to rotatable pin 36, and since the innermost or trailing end of coiled spring 30 is also secured to said pin 36 (by extending through a slot formed therein as depicted or by other suitable means), movement of said handle effects tightening or loosening of said coiled spring, depending upon which direction the handle is displaced. In FIG. 11, moving handle 48 having shelf 60 from the nine o'clock position to the 10:30 position as depicted tightens coiled spring 30 and increases its resistance to movement of resistance bar 40.

Thus, if the four positions in this embodiment are labeled L, M, H, and V for low, medium, high, and very high, the ten unique settings are LL, LM, LH, LV, MM, MH, MV, HH, HV, and VV.

Figure 7:
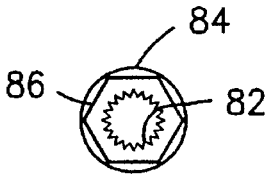
FIG. 7 is an end view of a novel screw.
Figure 8:
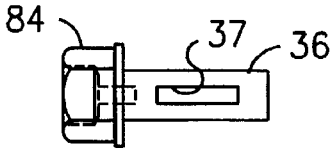
FIG. 8 is a side elevational view of the novel screw depicted in FIG. 7.
Figure 6:
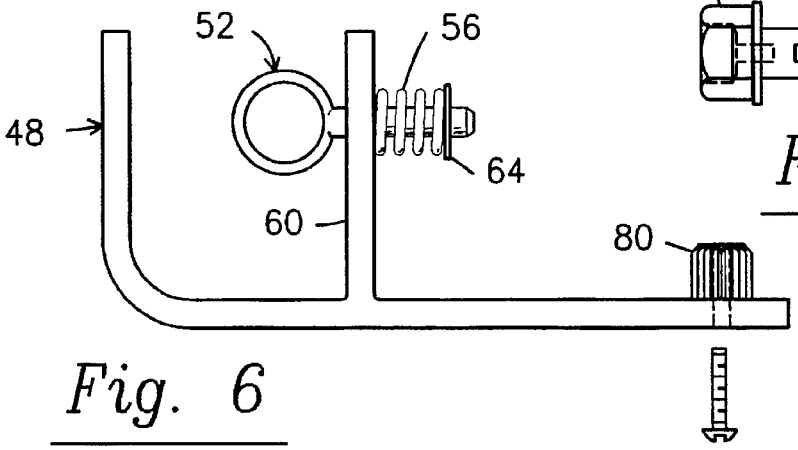
FIG. 6 is a top plan view of one of the novel handles.

If the amount of resistance offered by the VV setting is too low, the means of FIGS. 6–8 may be employed to increase the amount of bias offered by each spring. Such increase may be realized by any means for rotating pins 34 and 36 in a direction that increases the bias of the springs secured thereto.

In the preferred embodiment, this is accomplished by a knurled post 80 that is slideably received within knurled opening 82 formed in the head 84 of pin 36. A tool such as a crescent wrench, a pair of pliers, or the like is used to grip opposing flats 86 in the well known way to prevent spring-induced rotation of pin 36, and handle 48 is pulled away from subhousing 32 (after removal of screw 49) until knurled post 80 disengages from knurled opening 82. Handle 48 and hence knurled post 80 is then rotated counterclockwise in the view of FIGS. 5 and 9–11, knurled post 80 is reintroduced into knurled opening 82, and screw 49 is again engaged to secure said handle. When handle 48 is brought back to its depicted position, spring 30 will be more tightly coiled and it will offer increased resistance to pivotal displacement of resistance bar 40.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An exercise device, comprising:

an elongate base;

a housing secured to a preselected longitudinal edge of said base;

a first coiled spring disposed within said housing;

said first coiled spring being coiled about a spring axis that is disposed transverse to a longitudinal axis of said base;

said spring axis being formed by a pin, and said coiled spring having a trailing end secured to said pin;

an elongate, L-shaped resistance bar rotatably mounted with respect to said housing;

interconnecting means for interconnecting a leading end of said first coiled spring to said resistance bar so that a bias generated by said first coiled spring resists rotational movement of said resistance bar;

a first handle having an inner end connected to said pin and a second end disposed external to said housing so that said second end is manipulatable by a user of said device; and first locking means for locking said first handle into a plurality of positions;

whereby changing the position of said first handle adjusts the amount of bias exerted by said first coiled spring upon said resistance bar.

2. The device of claim 1, further comprising:

a second coiled spring disposed within said housing in laterally spaced apart relation to said first coiled spring;

said second coiled spring being coiled about a second spring axis that is disposed transverse to a longitudinal axis of said base;

said second spring axis being formed by a second pin, and said second coiled spring having a trailing end secured to said second pin;

interconnecting means for interconnecting a leading end of said second coiled spring to said resistance bar so that a bias generated by said second coiled spring resists rotational movement of said resistance bar;

a second handle having an inner end connected to said second pin and a second end disposed external to said housing so that said second end is manipulatable by a user of said device; and second locking means for locking said second handle into a plurality of positions;

whereby changing the position of said second handle adjusts the amount of bias exerted by said second coiled spring upon said resistance bar.

3. The device of claim 2, further comprising:

first and second subhousings for respectively housing said first and second coiled springs;

first and second curved plates mounted to said first and second subhousings, respectively;

a first and second plurality of spaced apart apertures formed in said first and second curved plates, respectively;

first and second detents mounted on said first and second handles, respectively; and first and second bias means for biasing each of said first and second detents into engagement with a preselected aperture of said first and second plurality of spaced apart apertures so that said first and second detents engage associated apertures when said first and second bias means are in repose.

4. The device of claim 3, further comprising:

adjustment means for independently adjusting the bias supplied to said resistance bar by said first and second coiled springs.

5. The device of claim 4, wherein said adjustment means further comprises:

an externally knurled post formed on each handle of said first and second handles; and an internally knurled opening formed in a head of said first and second pins for slideably receiving said externally knurled post;

whereby rotation of a pin of said first and second pins is prevented by gripping its head;

whereby when a head is gripped to prevent rotation of a selected pin of said first and second pins, said externally knurled post in an initial position is separated from said internally knurled opening and said handle is rotated in a predetermined direction so that upon reinsertion of said externally knurled post into said internally knurled head, and return of said handle to said initial position, its associated coiled spring exerts an increased amount of bias.

6. The device of claim 1, further comprising a transversely disposed hinge means formed in said base so that said base is foldable about said hinge means for storage.

7. The device of claim 2, further comprising a transversely disposed hinge means formed in said base so that said base is foldable about said hinge means for storage.

* * * * *